US005826142A

United States Patent [19]

Takahashi et al.

[11] Patent Number: 5,826,142

[45] Date of Patent: Oct. 20, 1998

[54] IMAGE FORMING APPARATUS AND ELECTROPHOTOGRAPHIC PHOTOSENSITIVE MEMBER TO BE USED THEREFOR

[75] Inventors: Michiaki Takahashi; Tomoo Kobayashi, both of Minami-Ashigara, Japan

[73] Assignee: Fuji Xerox, Ltd., Tokyo, Japan

[21] Appl. No.: 775,448

[22] Filed: Dec. 30, 1996

[30] Foreign Application Priority Data

Jan. 9, 1996 [JP] Japan ..... 8-001507
Jun. 27, 1996 [JP] Japan ..... 8-168018

[51] Int. Cl.[6] ..... G03G 15/00; G03G 15/08

[52] U.S. Cl. ..... 399/159; 399/343; 430/58; 430/125

[58] Field of Search ..... 399/149, 150, 399/159, 343, 347, 353; 430/56, 58, 59, 83, 125, 902

[56] References Cited

U.S. PATENT DOCUMENTS

| | | | |
|---|---|---|---|
| 5,177,553 | 1/1993 | Ohike et al. | 399/353 |
| 5,399,452 | 3/1995 | Takegawa et al. | 430/58 |
| 5,416,565 | 5/1995 | Noda | 399/176 |
| 5,483,329 | 1/1996 | Asanae et al. | 399/150 |
| 5,677,094 | 10/1997 | Umeda et al. | 430/58 |

FOREIGN PATENT DOCUMENTS

| | | |
|---|---|---|
| A-48-74230 | 10/1973 | Japan . |
| A-52-126230 | 10/1977 | Japan . |
| A-56-147166 | 11/1981 | Japan . |
| A-59-133573 | 7/1984 | Japan . |
| A-2-1870 | 1/1990 | Japan . |
| A-2-51168 | 2/1990 | Japan . |

*Primary Examiner*—Arthur T. Grimley
*Assistant Examiner*—Sophia S. Chen
*Attorney, Agent, or Firm*—Oliff & Berridge, PLC

[57] ABSTRACT

There is provided an image forming apparatus wherein the life of the photosensitive member is not extremely limited by scratches, abrasion, or the like. Also, there is provided an image forming apparatus free from such problems as image blurring due to products formed by electric discharge or foreign matters like paper powder (talc) transferred from the paper. Further, in an image forming apparatus for forming an image using an electrophotographic photosensitive member through the cycle of charging, latent image formation, development, and transfer, abrasion of the surface layer of said electrophotographic photosensitive member is in the range of 0.1 to 2.0 nm by the use of 1 kilocycle. An example of the preferred embodiments includes a charging device, exposing device, toner developing device, and transfer device disposed in the order of process sequence, and at least the charging device and the transfer device spaced from the electrophotographic photosensitive member.

15 Claims, 3 Drawing Sheets

IMAGE FORMING APPARATUS AND ELECTROPHOTOGRAPHIC PHOTOSENSITIVE MEMBER TO BE USED THEREFOR

BACKGROUND OF THE INVENTION

1. Field of the Invention

The present invention relates to an image forming apparatus and an electrophotographic photosensitive member to be used therefor.

2. Description of the Related Art

A conventional electrophotographic image forming apparatus commonly used such as a laser printer has a charging means 52, a toner image developing means 54, a transfer means 55, and a cleaning device 56 like a blade, around the electrophotographic photosensitive member 51, as schematically shown in FIG. 5.

A static latent image is formed on the electrophotographic photosensitive member 51 by the charging means 52 and a latent image writing light 53. The static latent image is formed into a toner image by the toner image developing means 54, and the toner image is transferred onto the recording medium 57 such as paper. After transferring the image, the toner remaining on the electrophotographic photosensitive member 51 is removed by a cleaning device 56 to be recovered. In such an image forming apparatus, the electrophotographic photosensitive member 51 has extremely limited life of durability because of abrasion and scratches as the photosensitive member is subjected to strong friction by the cleaning device 56.

In order to obviate these problems, there has been proposed a cleaner-less system as disclosed in JP-A No. 59-133573. However, even when a cleaner-less system is used, in case of the use of an organic photosensitive member, there arise such problems as deterioration of the surface of the photosensitive member due to charging (discharge) and image blurring caused by products formed by discharging or foreign matters such as paper powder (talc) from the paper which deposit or are transferred onto the surface of the photosensitive member. In order to obviate such problems, the electrophotographic photosensitive members are practically used while abrading the surface of the electrophotographic photosensitive member and removing the abraded materials. As a method for such abrasion-removing the surface of the electrophotographic photosensitive member, there has been known a method of separately providing a polishing roll or a method of setting the differences of rotating speeds between a charging roll, developing roll, transfer printing roll, etc. and the electrophotographic photosensitive member so that these rolls rotate slidably relative to the rotation of the electrophotographic photosensitive member. However, according to such methods, large extension of life of the electrophotographic photosensitive member cannot be expected in comparison with the case where the cleaning device are provided.

Even when a hard electrophotographic photosensitive member (e.g., amorphous silicon electrophotographic photosensitive member) is used, such problems as deterioration of the surface of the electrophotographic photosensitive member due to electric charging (discharge) and image blurring caused by products formed by discharging or foreign matters such as paper powder (talc) from the paper which deposit or are transferred onto the surface of the photosensitive member are essentially the same as those in the organic photosensitive member. Accordingly, it is the present state to use the electrophotographic photosensitive member by forcibly polishing the surface of the electrophotographic photosensitive member or in case of not polishing, by heating its surface with a heater and drying the surface, so as to prevent image blurring. Consequently, there have been problems such as increase of cost due to sophistication of structure, occurrence of defects in image quality due to the scratches on the surface of the electrophotographic photosensitive member, increase in power consumption, and the like.

SUMMARY OF THE INVENTION

Accordingly, the present invention has been made with the object of solving the problems in prior art as stated above.

Namely, an object of the present invention is to provide an image forming apparatus in which the life of the electrophotographic photosensitive member is not extremely limited by scratches, abrasion, or the like.

Another object of the present invention is to provide an image forming apparatus which does not cause such problems as image blurring caused by products formed by discharging or foreign matters such as paper powder (talc) transferred from the paper onto the surface of the photosensitive member and image blurring due to deterioration of the surface of the electrophotographic photosensitive member in the use for a long period of time.

Still further object of the present invention is to provide an electrophotographic photosensitive member which can be favorably utilized for such image forming apparatus.

As a result of extensive studies, the present inventors have found that such problems can be solved by the constitution as shown below.

The present invention is to provide an image forming apparatus in which an electrophotographic photosensitive member is used and an image is formed through the process cycle of charging, latent image formation, development, and image transfer, wherein abrasion of the surface layer of the electrophotographic photosensitive member is in the range of 0.1 to 2.0 nm by the use of 1 kilocycle.

Such an image forming apparatus includes the following aspects:

(A) an aspect in which means for applying pressure to the surface of the electrophotographic photosensitive member (hereinafter to be referred to simply as "photosensitive member") to allow foreign matters to adhere thereto or scrubbing means are not used, namely, means which allow to attain the same function as the pressure or scrubbing means where the means is spaced from the photosensitive member, and abrades very slightly the photosensitive member in such a manner that the means is not always in contact with the surface of the photosensitive member but is brought into contact with the surface of the photosensitive member at an appropriate time interval;

(B) an aspect in which means for attaining the original function in the state of reduced pressing force in place of the means as described above is used, for example, a transfer roll or charging roll driven by the photosensitive member is used to weaken the force exerted therebetween, and a slight difference in rotational speed between the means and the photosensitive member is present;

(C) an aspect in which foreign matters from the photosensitive member are recovered, and means for abrading very slightly the surface of the photosensitive member is used.

In the image forming apparatus using the photosensitive member having the constitution as above, means for positively abrading and removing abraded products from the surface of the photosensitive member is not required. Accordingly, the life of the photosensitive member is not extremely shortened due to scratches or abrasion. Further, such problem as image blurring due to products formed by discharging or foreign matters such as paper powder (talc) transferred from the paper does not arise. Furthermore, even in the use of the apparatus for a long period of time, image defects such as image blurring due to deterioration of the surface of the photosensitive member is not caused.

The present inventors have found that products formed by discharging or foreign matters such as paper powder (talc), transferred from the paper which adhere to the surface of the photosensitive member adhere very lightly in the initial stage, but their adhesion to the surface of the photosensitive member becomes firm when subjected to excessive pressing force or strong friction, and when such a state continues, image blurring or the like occurs. Accordingly, in case of the cleaner-less system as well as the cleaning device using a blade, when there is means to exert pressure or friction by which strong adhesion of the foreign matters is caused onto the periphery of the photosensitive member, it has been required to abrade and remove excessively the photosensitive member.

To the contrary, it has been found that, when pressing means or friction means for allowing foreign matters to adhere firmly to the surface of the photosensitive member is excluded from all the surroundings of the photosensitive member of the image forming apparatus, or when the pressing force of such means is weakened, the foreign matters can be present in a state of relatively light adhesion to the photosensitive member, so that the foreign matters are carried away by being adhered to the developed toner or to the paper in the transfer process and is not apt to be accumulated on the photosensitive member.

Also, it is especially effective to provide the image forming apparatus with means for recovering the foreign matters from the photosensitive member. Such means may be one to have the foreign matter re-adhere to the photosensitive member with a light force. For example, it is preferable to use a brush-like means as recovering means. This may be a brush shaped unit, or of course a magnetic brush formed by a developer. In such a case, the recovering means may be used also as a developing means.

In such an image forming apparatus, image blurring by the products formed by discharging or paper powder, or the like can be obviated without causing the photosensitive member to be abraded. However, when a photosensitive member is used for an extremely long period, image blurring may occur by the degradation of the surface of the photosensitive member.

Such image blurring can be obviated by abrading gradually the surface of the photosensitive member in extremely limited degree. The abrading degree may be 0.1 to 2.0 nm in the use of 1 kilocycle. As this is far smaller than the range where abrasion is life-determining for the photosensitive member, there is utterly no problem in the practical use.

As a means of abrading the surface of the photosensitive member little by little as above, the brush-like recovery means or magnetic brush as described above can be used. Alternatively, there is a method of contacting/moving slidingly a polishing roll with the photosensitive member at an appropriate time interval. In such a case, it is possible to select the conditions not to cause the polishing roll to have foreign matters such as products formed by discharging or paper powder firmly adhere to the photosensitive member.

Although all the photosensitive members usable in the field of the art are applicable to the image forming apparatus of the present invention, it is more desirable for the photosensitive member to be such one as is less apt to cause adhesion of foreign matters to the surface thereof. This is realized, for example, by overcoating a film having a high releasing property on the surface of the photosensitive member. Further, when the photosensitive member is an organic photosensitive member, it is more desirable to select an electric charge transport agent having a strong resistance to deterioration of the surface of the photosensitive member caused by exposing the photosensitive member to gas formed by discharging, as shown below.

Namely, the charge transport agent has 0.7V vs SCE Saturated Calomel Elect or higher of oxidation potential wherein 0.7 indicates a potential with respect to SCE. SCE is commonly used as a reference electrode.

The charge transport agent is triarylamine compound represented by the following formula (1):

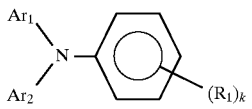

(1)

wherein $R_1$ is an alkyl group having 1 to 4 carbon atoms or a phenyl group, and k denotes an integer of 0 to 2; $Ar_1$ and $Ar_2$ are selected from the substituted or unsubstituted aryl groups which are independent from one another; the substituents of the aryl groups are a halogen atom, an alkyl group, an alkoxy group, and a substituted amino group.

DESCRIPTION OF THE PREFERRED EMBODIMENTS

Hereinafter, the present invention is illustrated in more detail by way of the embodiments thereof.

Figure 1:
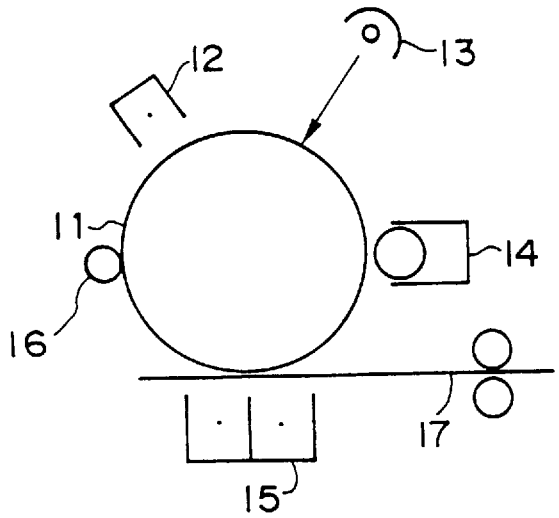
FIG. 1 is a schematic view of an embodiment of the image forming apparatus of the present invention.
Figure 2:
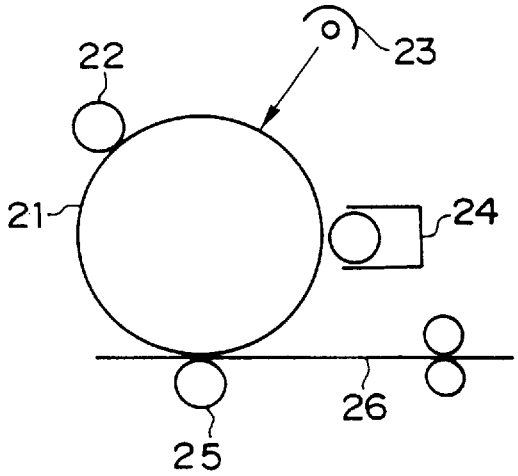
FIG. 2 is a schematic view of another embodiment of the image forming apparatus of the present invention.
Figure 3:
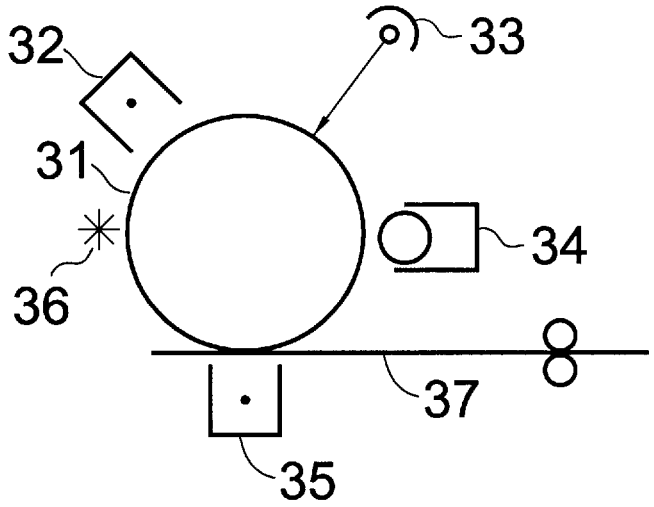
FIG. 3 is a schematic view of another embodiment of the image forming apparatus of the present invention.

The typical examples of the image forming apparatus of the present invention are schematically shown in FIGS. 1 to 3. With the image forming apparatuses shown herein, abrasion of the surface layer of the photosensitive member maybe set to 0.1 to 2.0 nm, through 1000 cycles of the process including charging, latent image forming, developing, and image transfer, even when an organic photosensitive member is used as an electrophotographic photosensitive member.

FIG. 1 shows an embodiment of the image forming apparatus according to the present invention. In this embodiment, a pressing means or friction means which allows foreign matters to adhere firmly onto the surface of the photosensitive member is omitted from the surroundings of the photosensitive member of the image forming apparatus. The means is not in contact at all times with the surface of the photosensitive member but is brought into contact with the surface of the photosensitive member at an appropriate time interval to abrade the photosensitive member very slightly. The apparatus comprises a drum-like photosensitive member 11, around which there are disposed a charging scorotron 12, an exposure device 13, a toner image developing device 14, a transfer corotron 15, and a polishing roll 16, in the order of processing, for recording the image on the paper 17 which is fed. The charging scorotron 12 and transfer corotron 15 are spaced at a distance from the photosensitive member 11. The toner developing device 14 may be in contact with the surface of the photosensitive member 11 to such a degree that the developing device 14 can perform its function, but the developing device 14 should not strongly press the surface of the photosensitive member 11. The toner image developing device may not be a special one but can be selected from those in ordinary use in the industrial field. For example, a toner developing device utilizing a magnetic brush may be employed. The polishing roll 16 can be of a roll with urethane foam molded on the surface of a metal shaft. The polishing roll is spaced from the photosensitive member 11 during the ordinary image forming cycle and, it is brought into contact with the photosensitive member to be slidably moved for every image forming cycle of, for example, about 100 to 10,000 times, thereby very slightly abrading the surface of the photosensitive member. The amount of the abrasion is about 0.1 to 2.0 nm per 1000 times of image forming cycles for the purpose of removing the deteriorated portion on the surface of the photosensitive member. In case of pressing the polishing roll to the photosensitive member at all times to allow the roll to be slidably moved, there is a tendency to cause lightly adhered products formed by discharging or paper powder in the initial stage rather to fix on the surface of the photosensitive member, so that it becomes necessary to abrade the photosensitive member excessively. However, according to the proposed method, it is sufficient to abrade slightly the photosensitive member.

FIG. 2 shows another embodiment of the image forming apparatus of the present invention, in which there are arranged in the order of process of a charging roll 22, an exposing device 23, a toner developing device 24, and a transfer roll 25 around a drum-shaped photosensitive member 21. The charging roll 22 and the transfer roll 25 simply follow the rotation of the photosensitive member 21, and the rolls 22 and 25 do not strongly press the surface of the photosensitive member 21. The peripheral speeds of the photosensitive member 21 and the two rolls 22, 25 are very slightly different from each other. The difference may be of a degree of for example about 1% to 5%. By adequately selecting the pressure and the difference in the peripheral speeds, abrasion of the surface of the photosensitive member 21 can be made from 0.1 to 2.0 nm per 1000 times of image forming cycles. The toner developing device 24 is the same as that shown in FIG. 1. Numeral 26 denotes paper.

FIG. 3 shows still another embodiment of the image forming apparatus of the present invention, which has a structure of a cleaning brush 36 being disposed between a charging corotron 32 and transfer corotron 35. The cleaning brush 36 is to recover foreign matters on a photosensitive member 31. Though there may be cases in which the foreign matters are transferred again onto the photosensitive member 31, the foreign matters can be recovered, and strong adhesion of the foreign matters onto the photosensitive member 31 can be prevented. As the cleaning brush 36, for example, acrylic fibers or nylon fibers may be used. By appropriately selecting the toughness, hardness and difference between the peripheral speed of the cleaning brush 36 and that of the photosensitive member 31, it is possible to make the abrasion of the surface of the photosensitive member 31 to a degree of 0.1 to 2.0 nm per 1000 times of image formation cycles. Numeral 33 denotes an exposure device, and numerals 34 and 37 denote a toner developing device, and paper, respectively.

As shown in FIG. 3, the image forming apparatus of the present invention is made so as not to cause foreign matters to adhere firmly onto the surface of the photosensitive member and not to cause the photosensitive member to be abraded. If the cleaning device per se or other processing devices in the surroundings of the photosensitive member have a function to make the abrasion of the surface of the photosensitive member in the range of 0.1 to 2.0 nm per 1000 times of image forming cycles, there may be provided the cleaning device. Especially, among the examples of the cleaning device per se having the function to allow the surface of the photosensitive member to be abraded as above, there are magnetic brush cleaning device and the like, besides the brush cleaning device as shown in FIG. 3. Further, in case of the use of the photosensitive member in combination with other processing devices which function to abrade the photosensitive member as above, an electric field cleaning method or the like utilizing mainly the electric field which is analogous to an image transfer is preferable.

In a conventional cleaning device, a method for strongly rubbing the photosensitive member so as to satisfy all conditions which include the case of high image density or low image density, and which vary with environment and time has been used. Here, even if there may be remaining toner produced under certain conditions in order to give priority to such conditions as not to abrade the photosensitive member without strong rubbing, for example, it is possible to obviate such a problem by combining the system with a system of cleaning simultaneously with development.

It is more desirable for the image forming apparatus of the present invention to be combined with a cleanerless system as represented by the system of cleaning simultaneously with development as disclosed in JP-A No. 59-133573. It is preferable for this system to be combined with a transfer system which shows a high transfer efficiency. As to the procedures to make the transfer efficiency as high as possible, those applicable are the conventionally known methods, e.g. a method of pre-processing prior to transfer for facilitating transfer as described in JP-A No. 48-74230, a method of vibrating a toner and/or carrier by applying ultrasonic wave thereto as described in JP-A No. 52-126230, a method of transferring an image utilizing an intermediate whose properties are stabilized as described in JP-A No. 56-147166, a method of mixing hydrophobic silica with a developer in a predetermined ratio as described in JP-A No. 2-1870, a method of utilizing a spherical toner as described in JP-A No. 2-51168, a method of providing unevenness on the surface of an electrophotographic photosensitive member in a pitch finer than the toner particle diameter, a method of forming a film having good releasing property on the surface of an electrophotographic photosensitive member, and the like.

Further, as a desirable method for keeping the transfer efficiency as high as possible in a stable state for a long period of time, there is a method of developing the toner image after applying fine particles to a photosensitive member. As has hitherto been in practice, in case that the surface of the photosensitive member or the surface of the developer (toner) are modified, there is a tendency for the transfer efficiency to become lower little by little because of the abrasion with time, surface deformation, separation of fine particles, etc. However, according to the above method, it is possible to allow the fine particles definitely to intervene between the photosensitive member and the toner, thereby making it possible to alleviate the access force between the photosensitive member and the toner such as van der Waals forces and thus to improve the transfer efficiency.

Further, a method of applying fine particles to the photosensitive member before development is very effective for preventing defects of image quality such as image blurring or the like caused by adhesion of foreign matters to the photosensitive member and the like. This is presumed to be due to the fine particles acting to prevent adhesion of the fine particles to the photosensitive member.

Figure 6:
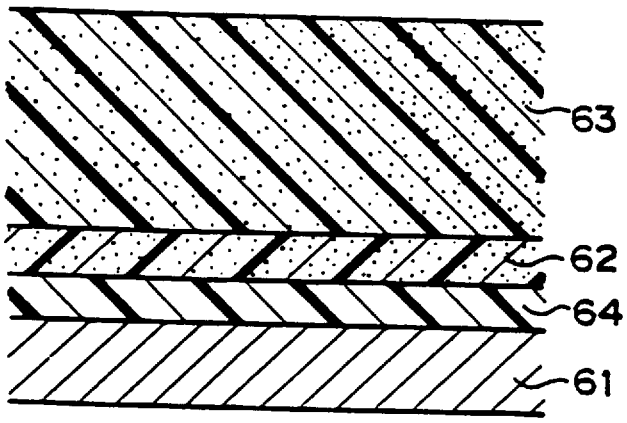
FIG. 6 is a schematic cross-sectional view of an embodiment of an electrophotographic photosensitive member utilizable for the image forming apparatus of the present invention.

Next, explanation is made on the electrophotographic photosensitive member which can be utilized for the image forming apparatus of the present invention. FIG. 6 is a schematic view showing a cross-section of an embodiment of such a photosensitive member. The photosensitive member is formed by placing a charge generation layer 62 and a charge transport layer 63 on a conductive support 61 via an undercoating layer 64.

The conductive support 61 may include a metal drum and sheet of aluminum, copper, stainless steel, or the like, a support in which a metal foil such as aluminum is laminated, or aluminum or metal is vapor-deposited on a plastic film and paper, and further a metal or resin drum coated with a resin layer made by dispersing conductive particles therein, and the like. The surface of the above conductive support may be roughened to prevent occurrence of interference fringes, if necessary.

The undercoating layer 64 may be provided, if necessary, for the purpose of improving adhesive property between the above conductive support 61 and the photosensitive layer (charge generation layer 62 and charge transport layer 63) or preventing imperfections of coating of the photosensitive layer. As the materials for forming the undercoating layer 64, there are known thermoplastic resins such as polyvinyl acetate, polyvinyl alcohol, polyvinyl butyral, polyvinyl methyl ether, polyamide, thermoplastic polyester, phenoxy resin, casein, gelatin, nitrocellulose; thermosetting resins such as polyimide, polyethylene imine, epoxy resin, melamine resin, phenol resin, polyurethane resin; and organic metal compounds such as titanium coupling agent, zirconium coupling agent, silane coupling agent, and the like. These materials can be used either solely or in mixture of two or more of them.

The undercoating layer 64 is formed through such steps as dissolving the above materials, if necessary, in a solvent and mixing, and diluting, applying the material onto the conductive support by spray coating, dip coating, or the like, followed by drying at a temperature in the range of 100° to 200° C.

The thickness of the undercoating layer 64 is optionally set in the range of 0.1 to 10 $\mu$m, and preferably in the range of 0.5 to 2 $\mu$m.

The charge generation layer 62 is formed by dissolving a binder resin in a solvent, dispersing a charge generation material therein, coating the resultant solution by spray coating or dip coating process, and thereafter drying, or by directly forming a film by vacuum evaporating the charge generation material or the like.

As the charge generation material, there can be used, for example, azo dyes such as Chlorodyean blue, quinone pigments such as antoantrone, pyrene quinone, quinocyanine pigments, perylene pigments, Indigo pigments, bisbenzoimidazole pigments, phthalocyanine pigments such as nonmetallic phthalocyanine, copper phthalocyanine, vanadyl phthalocyanine, titanyl phthalocyanine, gallium phthalocyanine, azulenium salt, squalilium pigments, quinacridon pigments, etc.

As the binder resin, there may be exemplified insulating resins such as polyvinyl butyral, polyallylate (polymer of bisphenol A with phthalic acid), polycarbonate resins, polyester resins, phenoxy resins, vinyl chloride-vinyl acetate copolymer, polyvinyl acetate, acryl resins, polyacrylamides, polyamide resins, polyvinyl pyridine, cellulose resins, urethane resins, epoxy resins, casein, polyvinyl alcohol, polyvinyl pyrrolidone, etc.

The thickness of the charge generation layer 62 is optionally set in the range of 0.01 to 5 $\mu$m, preferably in the range of 0.1 to 0.5 $\mu$m.

The charge transport layer 63 is formed by dissolving a binder resin in a solvent, adding a charge transport agent thereto to make a solution, applying the resulting solution by spray coating or dip coating, followed by drying.

In case that the surface of the electrophotographic photosensitive member is deteriorated by exposure to gas generated by electric discharge to cause image defects such as image blurring, one of its causes lies in the fact that the charge transport agent contained in the photosensitive member is oxidized by the gas generated by the electric discharge and the like. Therefore, in case of using the photosensitive member with suppression of the abrasion rate, if the charge transport agent contained in the photosensitive member has high anti-oxidation property, there is a less tendency for the image defects to occur.

According to the study by the present inventors, such anti-oxidation property of the charge transport agent is correlated with the oxidation potential thereof. In the image forming apparatus of the present invention in which the abrasion rate of the surface layer of the electrophotographic photosensitive member is no more than 2.0 nm by the use of 1 kilocycles, when the photosensitive member contains a charge transport agent having 0.7V vs SCE or higher of an oxidation potential, there is a less tendency for the image defects to occur.

The charge transport agent can be optionally selected from polycyclic aromatic compounds such as anthracene, pyrene, phenanthrene, or nitrogen-containing heterocyclic compounds such as indole, carbazole, imidazole, and pyrazoline compounds, hydrazone compounds, triphenylmethane compounds, triarylamine compounds, enamine compounds, stilbene compounds, etc. of which the oxidation potential is 7.0V vs SCE or higher. Especially, the triarylamine compounds represented by the following formula (1) exhibit remarkable effects.

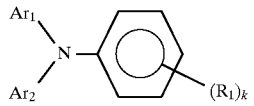

(1)

wherein $R_1$ is an alkyl having carbon atoms of 1 to 4 or phenyl group; k is an integer of 0 to 2; $Ar_1$ and $Ar_2$are independently selected from substituted or unsubstituted aryl groups (e.g., a phenyl, biphenyl, napththyl, anthryl or pyrenyl group); and substituents of the aryl groups are a halogen atom, an alkyl group (preferably carbon atoms of 1 to 5), an alkoxy group (preferably carbon atoms of 1 to 5) or substituted amino group (e.g. substituted with methyl, ethyl, benzyl, phenyl or toryl group).

Table 1 shows examples of the triarylamine compounds of the formula (1) and respective oxidation potentials thereof. It should be noted however that the charge transport agents usable in the present invention are not limited to those listed herein. Further, these materials can be used either solely or in mixture of two or more of them.

TABLE 1

Examples of compounds usable as charge transport agents

Compound 1

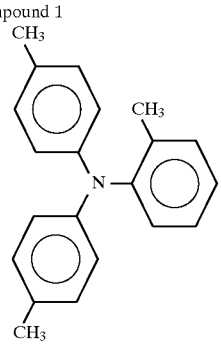

Eox = 0.91

Compound 4

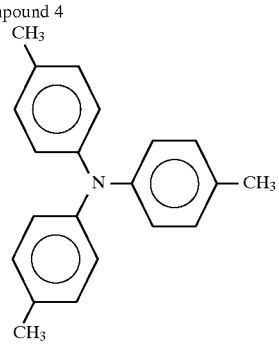

Eox = 0.80

Compound 2

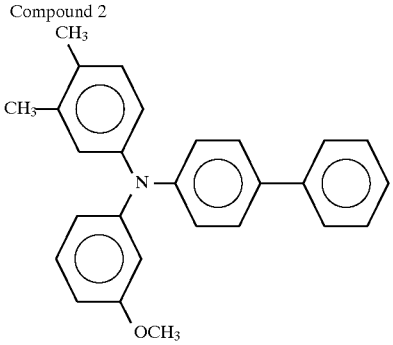

Eox = 0.94 nCompound 5

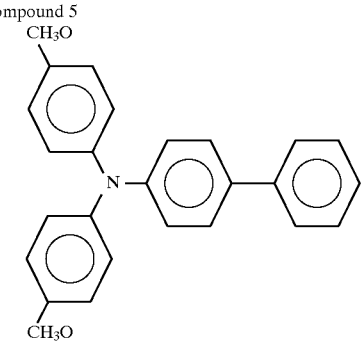

Eox = 0.83

Compound 3

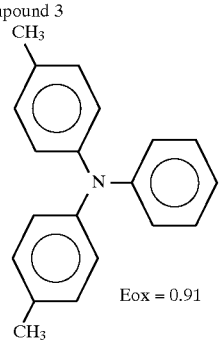

Eox = 0.91

Eox = 0.91

Compound 6

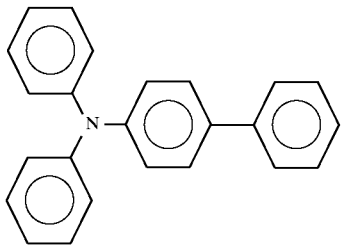

Eox = 0.97

Compound 7

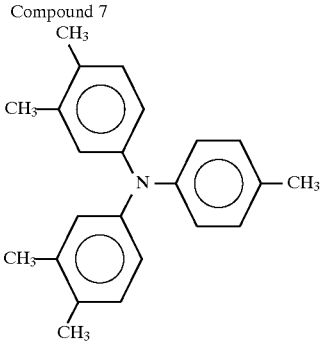

Eox = 0.75

Compound 10

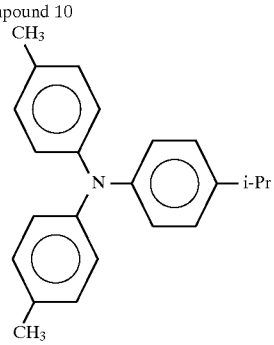

Eox = 0.80

TABLE 1-continued
| Examples of compounds usable as charge transport agents |
|---|
| Compound 8 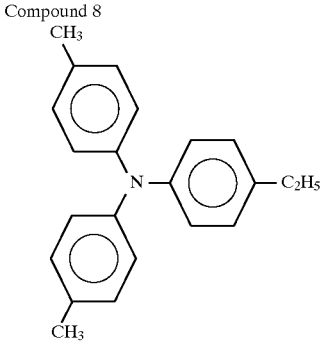 Eox = 0.79 |
| Compound 11 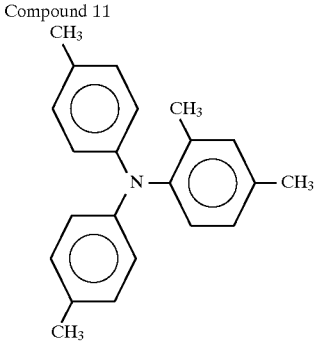 Eox = 0.83 |
| Compound 9 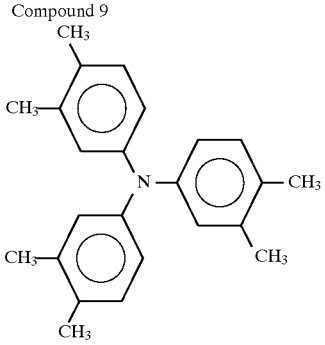 Eox = 0.72 |
| Compound 12 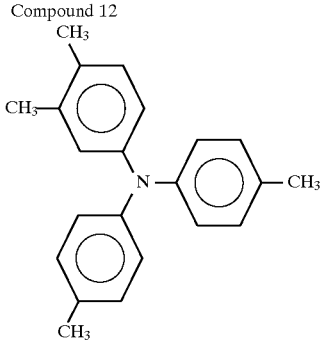 Eox = 0.78 |
| Compound 13 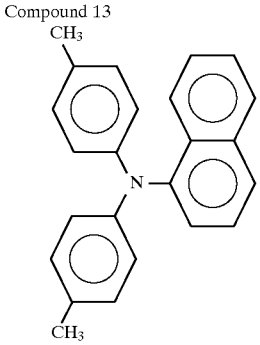 Eox = 0.89 |
| Compound 16 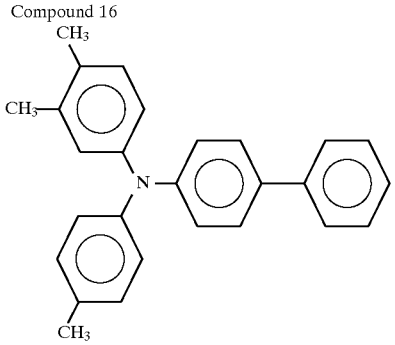 Eox = 0.80 |
| Compound 14 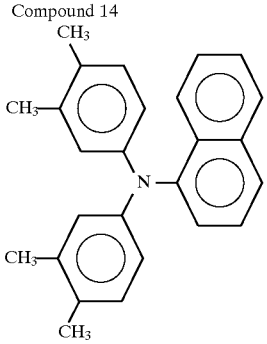 Eox = 0.83 |
| Compound 17 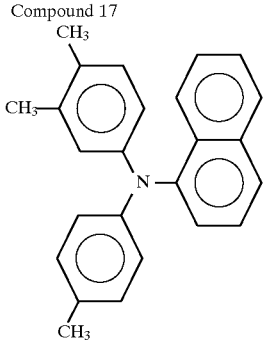 Eox = 0.86 |

TABLE 1-continued
| Examples of compounds usable as charge transport agents |
|---|
| Compound 15 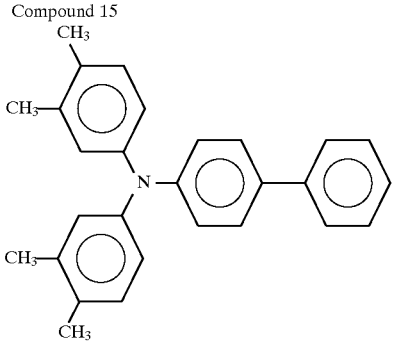 Eox = 0.78 |
| Compound 18 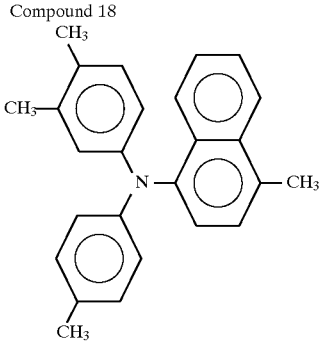 Eox = 0.80 |
| Compound 19 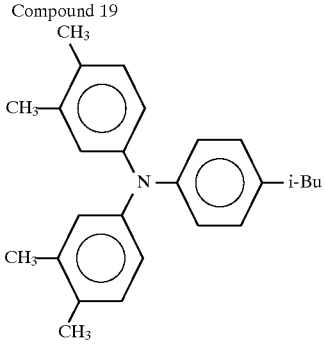 Eox = 0.74 |
| Compound 22 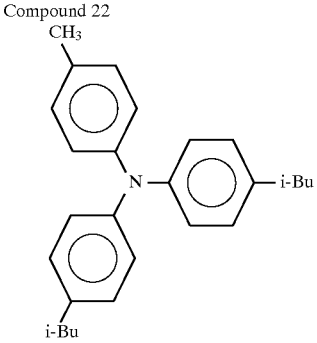 Eox = 0.79 |
| Compound 20 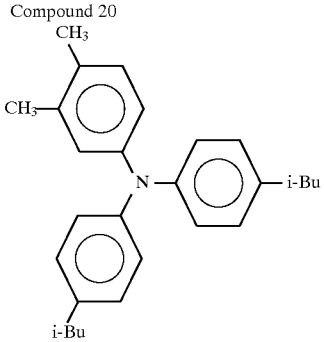 Eox = 0.76 |
| Compound 23 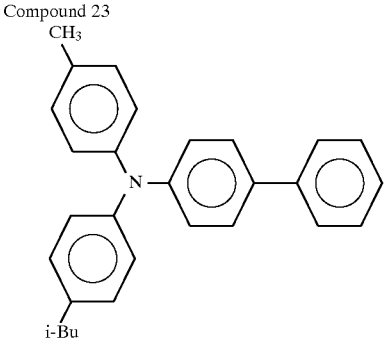 Eox = 0.84 |
| Compound 21 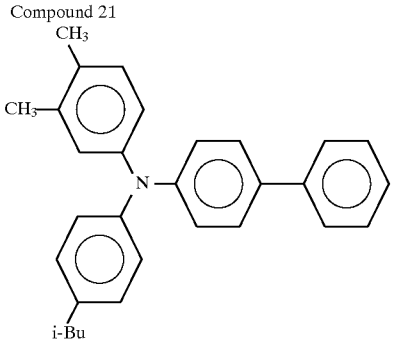 Eox = 0.81 |
| Compound 24 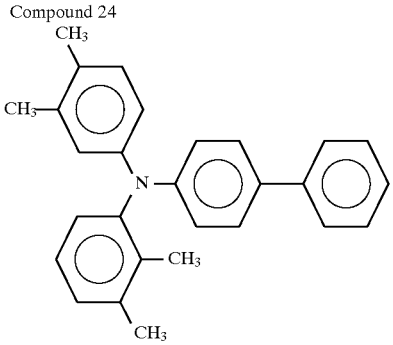 Eox = 0.86 |

TABLE 1-continued

| Examples of compounds usable as charge transport agents | |
|---|---|
| Compound 25 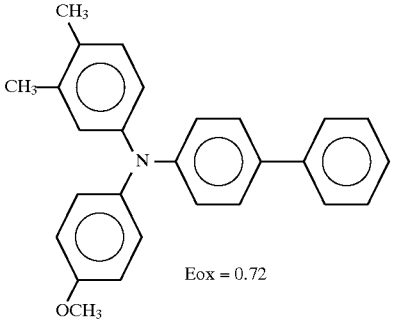 Eox = 0.72 | In the table, Eox represents oxidation potential. Unit is V vs SCE. |

Measurements of the oxidation potentials of the charge transport agents were carried out by CV measurement (YANAGIMOTO VOLTANEMETRIC ANALYZER, Model P-1000, working electrode, counter electrode: platinum electrode, reference electrode: saturated calomel electrode) in dichloromethane solution thereof (supporting electrolyte, 0.1M-TBAP).

Further, to prevent oxidation of the charge transport agents, it is effective to add a hindered phenol compound or hindered amine compound thereto, as an anti-oxidation agent.

Specific examples of the hindered amine compounds which can be used in the present invention include octylated diphenylamine, 4,4'-bis (α,α'-dimethylbenzyl) diphenylamine, N,N'-diphenyl-p-phenylenediamine, N-isopropyl-N'-phenyl-p-phenylenediamine, N-1,3-dimethyl-N'-phenyl-p-phenylenediamine, N-1-methylheptyl-N'phenyl-p-phenylenediamine, N-(3-methacryloyloxy-2-hydroxypropyl)-N'-phenyl-p-phenylenediamine, 2,2,4-trimethyl-1,2-dihydroquinoline polymer, 6-ethoxy-2,2,4-trimethyl-1,2-dihydroquinoline, diphenylamine derivatives, alkylated diphenylamine, etc.

Further, specific examples of hindered phenol compounds include triethylene glycol-bis[3-(3-t-butyl-5-methyl-4-hydroxyphenyl)propionate, 1,6-hexanediolbis[3-(3,5-di-t-butyl-4-hydroxyphenyl)propionate], 2,4-bis(n-octylthio)-6-(4-hydroxy-3,5-di-t-butylanilino) 1,3,5-triazine, pentaerythrityl-tetrakis[3-(3,5-di-tbutyl-4-hydroxy-phenyl) propionate], 2,2-thiodiethylenebis[3-(3,5-di-t-butyl-4-hydroxyphenyl) propionate], octadecyl-3-(3,5-di-t-butyl-4-hydroxyphenyl)propionate, N,N'-hexamethylenebis(3,5-di-t-butyl-4-hydroxyhydrocynnamide, 3,5-di-t-butyl-4-hydroxy-benzylphosphonate diethyl ester, 1,3,5-trimethyl-2,4,6-tris-(3,5-di-t-butyl-4-hydroxybenzyl) benzene, bis(3,5-di-t-butyl-4-hydroxybenzyl ethyl phosphonate)calcium, tris (3,5-di-t-butyl-4-hydroxybenyl)isocyanulate, octylated diphenylamine, 2,4-bis[(octylthio)methyl]-o-cresole, 2,6-di-t-butyl-4-methylphenol, 2,6-di-t-butyl-4-ethylphenol, stylenated phenol, 2,2'-methylenebis(4-methyl-6-t-butyl-phenol), 2,2'-methylenebis(4-ethyl-6-t-butyl-phenol), 4,4'-butylidenebis(3-methyl-6-t-butyl-phenol), 2,5-di-t-butylhydroquinone, 2,5-di-t-amylhydroquinone, 2-t-butyl-6-(3-butyl-2-hydroxy-5-methylbenzyl)-4-methylphenylacrylate, 2-[1-(2-hydroxy-3,5-di-t-pentylphenyl)ethyl-4,6-di-t-pentylphenylacrylate, 4,4'-butylidenebis(3-methyl-6-t-butylphenol), 4,4'-thiobis(3-methyl-6-t-butylphenol), 4,4'-thiobis(2-methyl-6-t-butylphenol), 3,9-bis{2-[3-t-butyl-4-hydroxy-5-methylphenyl]propionyloxy}-1,1-dimethyl]2,4,8,10-tetraoxaspiro[5,5]undecane, alkylatedbisphenol, phenol derivatives, and the like.

The total amount of addition of the anti-oxidant is desirably in the range of 0.07% by weight to 10% by weight based on the total layer to be added therein.

Examples of the binder resins which can be used for the charge transport layer are known ones such as polycarbonate resins, polyester resins, methacryl resins, acryl resins, polyvinyl chloride resin, polyvinylidene chloride resin, polystyrene resin, polyvinylacetate resin, styrene-butadiene copolymer, vinylidene chlorideacrylonitrile copolymer, vinyl chloride-vinyl acetate copolymer, vinyl chloride-vinyl acetate-maleic anhydride copolymer, silicon resins, silicon-alkyd resins, phenol-formaldehyde resin, styrene-alkyd resins, polyN-vinylcarbazole, polysilane, and the like, though the binder resins are not limited to the above resins.

The thickness of the charge transport layer is optionally set in the range of 5 to 40 μm, preferably in the range of 15 to 35 82 m.

EXAMPLES

Example 1

| | by weight |
|---|---|
| Acetyl acetone zirconium butoxide (ORGATICS ZC540, made by Matsumoto Kosho) | 20 parts |
| γ-aminopropyl triethoxysilane (A1100, made by Nippon UNICAR Co., LTD.) | 2 parts |
| Polyvinyl butyral resin (ESLEC BM-S, made by Sekisui Chemical Co., Ltd.) | 1.5 parts |
| n-Butyl alcohol | 70 parts |

A solution comprising the above-listed components was dip-coated on an aluminum pipe, and thereafter the coating was dried at 150° C. for 10 minutes to form an undercoat layer having a thickness of 0.9 μm.

| | by weight |
|---|---|
| X-type non-metallic pthalocyanine | 5 parts |
| Vinyl chloride-vinyl acetate copolymer | 5 parts |

-continued

| | by weight |
|---|---|
| (VMCH, made by Union Carbide Corp.) n-Butyl acetate | 200 parts |

Next, the above components were dispersed with a sand mill using glass beads of 1 mmΦ in diameter for 2 hours, and the resulting dispersion was dip-coated on the above undercoat layer, which was dried at 100° C. for 10 minutes to form a charge generation layer having a thickness of 0.2 μm.

| | by weight |
|---|---|
| Compound 15 shown in Table 1 | 1 parts |
| Binder resin of Formula (1) | 1 parts |
| Monochlorobenzene | 6 parts |

(1)

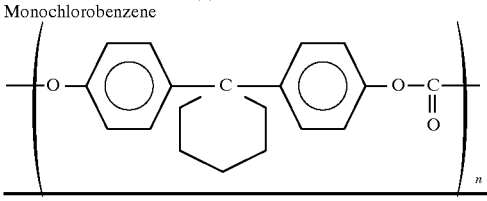

Next, a solution comprising the above components was dip-coated on the above charge generation layer, which was dried at 135° C. for 1 hour to form a charge transport layer having a thickness of 20 μm, thereby making a photosensitive member.

Figure 4:
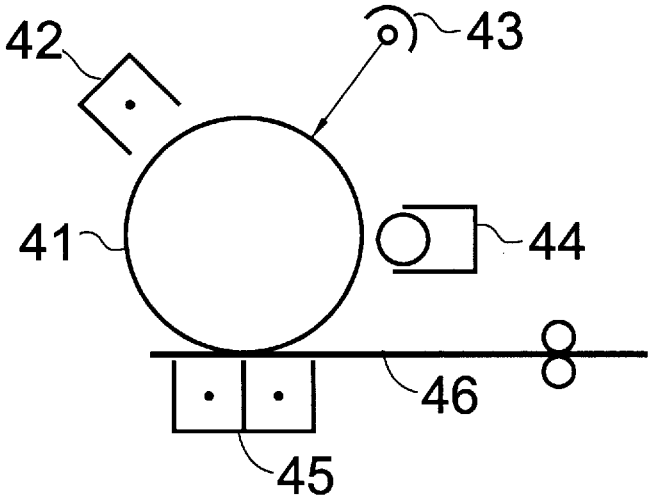
FIG. 4 is a schematic view of a further embodiment of the image forming apparatus of the present invention.

For evaluating the thus obtained photosensitive member, there was used an apparatus made by remodeling the digital copyingmachine (Abie-1301α, made by Fuji Xerox Co., Ltd.) whose structure was schematically shown in FIG. 4. In this case, in order to avoid excessive abrasion of the photosensitive member 41, a cleaning blade was removed. For charging and transferring images onto the paper 46, there were used a scorotron 42 and corotron 45 which were not in contact with the photosensitive member 41. The photosensitive member was subjected to weak sliding force by a magnetic brush of a two-component developing means 44. Owing to the removal of the cleaning blade, the residual toner after transferring is subjected to charging and exposure by an exposure device, but the toner is recovered in the developing device in the succeeding developing process, so that no problem arises. Numeral 43 is the exposure device.

According to the evaluation on the photosensitive member of the present example by using the apparatus as above, it was confirmed that the photosensitive member maintained excellent performance without causing any defect of image quality such as image blurring even after printing 500,000 sheets. By measuring the change of the thickness of the surface layer of the photosensitive member used in this example after printing about 500,000 sheets, it was found that the surface layer was abraded about 0.1 μm (in abrasion rate, about 0.1 nm/kcycle). It was presumed to be due to the friction between the magnetic brush and the photosensitive member.

Example 2

Except that the charge transport agent was changed to Compound 21 shown in Table 1, a photosensitive member was prepared in the same manner as in Example 1.

For evaluating the thus obtained photosensitive member, there was used an apparatus made by remodeling the digital copyingmachine (Able-1301α, made by Fuji Xerox Co., Ltd.) whose structure was schematically shown in FIG. 2. In this case, a cleaning blade was removed in the same manner as in Example 1, and further there were used a charging roll and a transfer roll for charging and transfer, respectively. Development was carried out by using a two-component developing device. The charging roll and the transfer roll were brought into contact with the photosensitive member without strong rubbing.

The photosensitive member of the present example was evaluated by using the apparatus as above. It was confirmed that the photosensitive member maintained excellent performance without causing any defect of image quality such as image blurring even after printing 500,000 sheets. By measuring the change of the thickness of the surface layer of the photosensitive member used in this example after printing about 500,000 sheets, it was found that the surface layer was abraded about 2 μm (in abrasion rate, about 2 nm/kcycle).

Example 3

Except that the charge transport agent was changed to Compound 23 shown in Table 1, a photosensitive member was prepared in the same manner as in Example 1.

For evaluating the thus obtained photosensitive member, there was used an apparatus made by remodelling the digital copying machine (Able-1301α, made by Fuji Xerox Co., Ltd.) whose structure was schematically shown in FIG. 3. In this case, a cleaning brush was used in place of the cleaning blade. Development was carried out by using a magnetic single-component developing device, which was not in contact with the photosensitive member. The charging device and transfer device were similar to those of Example 2.

The photosensitive member of the present example was evaluated by the use of the apparatus as above. It was confirmed that the photosensitive member maintained excellent performance without causing any defect of image quality such as image blurring even after printing 500,000 sheets. By measuring the change of the thickness of the surface layer of the photosensitive member used in this example after printing about 500,000 sheets, it was found that the surface layer was abraded about 1 μm (in abrasion rate, about 1 nm/kcycle).

Example 4

Except that the charge transport agent was changed to Compound 25 shown in Table 1 and 1 part by weight of 2,2'-methylenebis(4-methyl-6-t-butyl-phenol) was added, a photosensitive member was prepared in the same manner as in Example 1, and evaluation was made in the same manner as in Example 3. It was confirmed that the photosensitive member of the present Example maintained excellent performance without causing any defect of image quality such as image blurring even after printing 100,000 sheets.

Comparative Example 1

Except that the charge transport agent was replaced by Compound 26 shown in Table 2, a photosensitive member was prepared in the same manner as in Example 1, and the image quality preserving characteristic of the photosensitive member was evaluated by the use of a non-remodeled (with a cleaner) digital copying machine (Able-1301α, made by Fuji Xerox Co., Ltd.) . As a result, image blurring was not found even after printing 100,000 sheets, but the photosensitive member was found to be abraded by about 12 μm (in abrasion rate, about 6 nm/kcycle), and decrease in charging potential and image defects due to abrasion scratches, and the like were observed.

evaluated in the same manner as described above. As a result, the abrasion rate of the photosensitive member was no more than 2 nm/kcycle, but image blurring was observed on the prints after printing about 5,000 sheets.

TABLE 2

Charge transport agents used in Comparative Examples

Compound 26

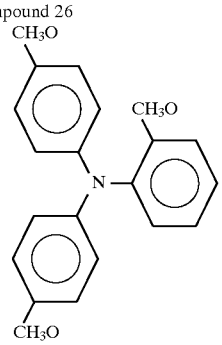

Eox = 0.66

Compound 27

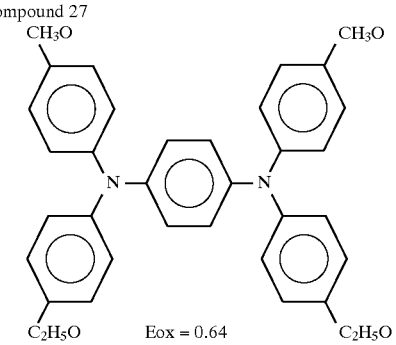

Eox = 0.64

Compound 28

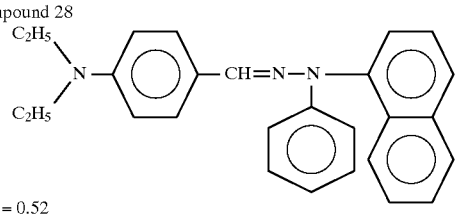

Eox = 0.52

In the table, Eox represents oxidation potential. Unit is V vs SCE.

Comparative Example 2

Except that the charge transport agent was replaced by Compound 26 shown in Table 2, a photosensitive member was prepared in the same manner as in Example 1. The image quality preserving characteristic of the photosensitive member was evaluated by the use of an apparatus for the evaluation which had a charging roll whose peripheral speed was different from that of the electrophotographic photosensitive member by 10%, by remodeling of the charging apparatus of digital copying machine (Able-1301α, made by Fuji Xerox Co., Ltd.) . As a result, significant image blurring was observed on the prints produced after 5,000 sheets, and after printing 10,000 sheets, the photosensitive member was found to be abraded by 10 μm (in abrasion rate, about 5 nm/kcycle), and a decrease in charging potential was observed.

Comparative Example 3

Except that the charge transport agent was replaced by Compound 27 shown in Table 2, a photosensitive member was prepared in the same manner as in Example 1, and evaluation was made in the same manner as described above. As a result, the abrasion rate of the photosensitive member was no more than 2 nm/kcycle, but image blurring was observed on the prints after printing about 5,000 sheets.

Comparative Example 4

Except that the charge transport agent was replaced by Compound 28 shown in Table 2, a photosensitive member was prepared in the same manner as in Example 1, and it was

Comparative Example 5

Figure 5:
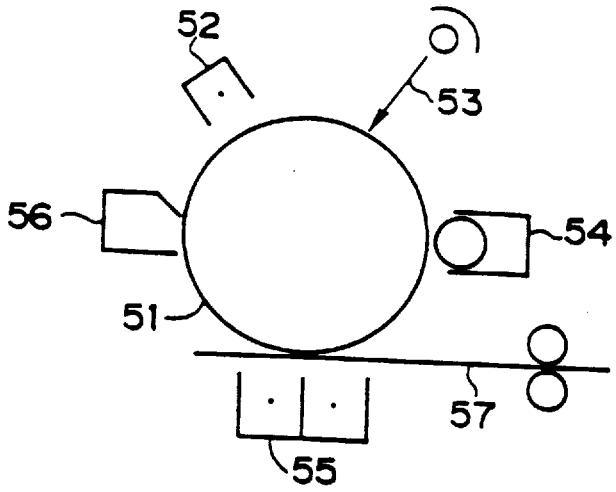
FIG. 5 PRIOR ART
FIG. 5 is a schematic view of an embodiment of the conventional image forming apparatus.

An apparatus was evaluated by using the photosensitive member of Example 1. The apparatus was prepared remodeling the digital copying machine (Able-1301α, made by Fuji Xerox Co., Ltd.) as shown in FIG. 5, in which the cleaning blade was removed, and a charging scorotron 52 and a transfer corotron 55 which were not in contact with the photosensitive member 51 were used for charging and transferring, respectively. Development was carried out by using a magnetic one-component developing device which was not in contact with the photosensitive member, so that the photosensitive member 51 was not brought into contact with anything other than paper in the image forming cycle. Numeral 53 denotes a latent image writing ray, numeral 54 denotes a toner developing device, and numeral 57 represents paper.

The photosensitive member of this Comparative Example evaluated with the thus obtained apparatus showed partial image blurring after printing 500,000 sheets. It was found that the surface layer of the photosensitive member used in this Example was not abraded even after printing 500,000 sheets.

According to the present invention, in an image forming apparatus using a photosensitive member, the life of the photosensitive member is not extremely limited by scratches, abrasion, or the like. Also, the image forming apparatus does not cause such problems as image blurring due to the adhesion or accumulation of products generated by electric discharge or the like onto the surface of the photosensitive member. Further, even in the use of the apparatus for a long period of time, image defects such as image blurring due to deterioration of the surface of the photosensitive member do not occur.

What is claimed is:

1. An electrophotographic organic photosensitive member for use in an image forming apparatus for forming an image, the electrophotographic organic photosensitive member comprising a charge transport agent-having an oxidation potential of more than 0.7V vs SCE.

2. An electrophotographic organic photosensitive member according to claim 1, wherein the charge transport agent is a triarylamine compound of the following formula (1):

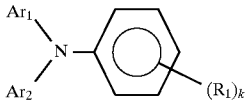

(1)

wherein $R_1$ is an alkyl group having 1 to 4 carbon atoms or a phenyl group; k is an integer of 0 to 2; $Ar_1$ and $Ar_2$ are independently selected from substituted and unsubstituted aryl groups; wherein substituents of the aryl group are at least one selected from the group of a halogen atom, an alkyl group, an alkoxyl group and a substituted amino group.

3. An electrophotographic organic photosensitive member according to claim 1, further comprising a surface layer, and abrasion of the surface layer being in the range of 0.1 to 2.0 nm over 1 kilocycle of a process cycle of charging, latent image forming, developing and image transfer using the image forming apparatus.

4. An image forming apparatus for forming an image, the image forming apparatus comprising an electrophotographic organic photosensitive member having a surface layer and forming an image through the process cycle of charging, latent image forming, developing, and image transfer, the electrophotographic organic photosensitive member being comprised of a charge transport agent having an oxidation potential of more than 0.7V vs SCE, and abrasion of the surface layer of the electrophotographic organic photosensitive member being in the range of 0.1 to 2.0 nm over the use of 1 kilocycle.

5. An image forming apparatus according to claim 4, wherein a charging device, exposing device, toner developing device, and transfer device are disposed around the electrophotographic organic photosensitive member in the order of the process, and at least the charging device, exposing device, and transfer device are spaced from the electrophotographic organic photosensitive member.

6. An image forming apparatus according to claim 5, wherein the charging device includes a charging scorotron and the transfer device includes a transfer corotron.

7. An image forming apparatus according to claim 5, further comprising a brush-form cleaning member, wherein the brush-form cleaning member is disposed in a position between the transfer device and the charging device, with a tip end of the brush-form cleaning member being disposed in a position to come into contact with the electrophotographic organic photosensitive member.

8. An image forming apparatus according to claim 7, wherein the charge transport agent is a triarylamine compound represented by the following formula:

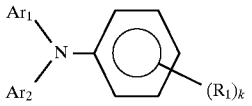

(1)

wherein $R_1$ is an alkyl group having 1 to 4 carbon atoms or a phenyl group; k is an integer of 0 to 2; $Ar_1$ and $Ar_2$ are independently selected from substituted and unsubstituted aryl groups; wherein substituents of the aryl group are at least one selected from the group of a halogen atom, an alkyl group, an alkoxyl group and a substituted amino group.

9. An image forming apparatus according to claim 8, wherein the electrophotographic organic photosensitive member contains a hindered phenol compound or a hindered amine compound as an antioxidant.

10. An image forming apparatus according to claim 4, wherein the electrophotographic organic photosensitive member is movable, and around which there are disposed, in the order of process sequence, a charging device which is rotated by the electrophotographic organic photosensitive member, a toner developing device, and a transfer device which is rotated by the electrophotographic organic photosensitive member.

11. An image forming apparatus according to claim 10, further comprising a brush-form cleaning member, the brushing-form cleaning member being disposed in a position between the transfer device and the charging device, and the brush-form cleaning member having a tip end disposed in a position to come into contact with the electrophotographic organic photosensitive member.

12. An image forming apparatus according to claim 10, wherein the charge transport agent is a triarylamine compound represented by the following formula:

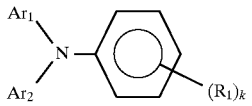

(1)

wherein $R_1$ is an alkyl group having 1 to 4 carbon atoms or a phenyl group; k is an integer of 0 to 2; $Ar_1$ and $Ar_2$ are independently selected from substituted and unsubstituted aryl groups; wherein substituents of the aryl group are at least one selected from the group of a halogen atom, an alkyl group, an alkoxyl group and a substituted amino group.

13. An image forming apparatus according to claim 12, wherein the electrophotographic organic photosensitive member contains a hindered phenol compound or a hindered amine compound as an antioxidant.

14. An image forming apparatus according to claim 4, wherein the charge transport agent is a triarylamine compound represented by the following formula:

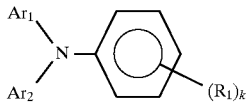

(1)

wherein $R_1$ is an alkyl group having 1 to 4 carbon atoms or a phenyl group; k is an integer of 0 to 2; $Ar_1$ and $Ar_2$ are independently selected from substituted and unsubstituted aryl groups; wherein substituents of the aryl groups are at least one selected from the group of a halogen atom, an alkyl group, an alkoxyl group and a substituted amino group.

15. An image forming apparatus according to claim 14, wherein the electrophotographic organic photosensitive member contains a hindered phenol compound or a hindered amine compound as an antioxidant.

* * * * *